US005444962A

United States Patent [19]

Bonnet

[11] Patent Number: 5,444,962

[45] Date of Patent: Aug. 29, 1995

[54] METHOD AND APPARATUS FOR LOADING AND CLOSING A CONTAINER

[75] Inventor: Henri Bonnet, Atlanta, Ga.

[73] Assignee: United Parcel Service of America, Inc., Atlanta, Ga.

[21] Appl. No.: 195,875

[22] Filed: Feb. 14, 1994

[51] Int. Cl.[6] ..... B65B 51/00

[52] U.S. Cl. ..... 53/417; 53/139.1; 53/459; 53/469

[58] Field of Search ..... 53/459, 585, 399, 510, 53/469, 284.7, 501, 417, 139.1; 141/114, 166, 314, 315, 287

[56] References Cited

U.S. PATENT DOCUMENTS

| | | | |
|---|---|---|---|
| 3,097,459 | 7/1963 | Rausch . | |
| 3,375,634 | 4/1968 | Jarund . | |
| 3,384,134 | 5/1968 | Hillerns . | |
| 3,393,633 | 7/1968 | Hoffman et al. . | |
| 3,538,671 | 11/1970 | Wallace | 53/459 |
| 3,731,454 | 5/1973 | Crabb . | |
| 3,896,605 | 7/1975 | Chevalier . | |
| 3,968,626 | 7/1976 | Hobbs | 53/570 |
| 4,162,602 | 7/1979 | Achelpohl et al. . | |
| 4,648,233 | 3/1987 | Holland . | |
| 4,689,937 | 9/1987 | Finan, Sr. et al. | 53/570 |
| 5,146,847 | 9/1992 | Lyon et al. | 53/399 |
| 5,339,607 | 8/1994 | Regier | 53/501 |

FOREIGN PATENT DOCUMENTS

| | | | |
|---|---|---|---|
| 2053129 | 2/1981 | United Kingdom | 141/287 |

*Primary Examiner*—John Sipos
*Assistant Examiner*—Gene L. Kim
*Attorney, Agent, or Firm*—R. Anthony Diehl; Steve Mendelsohn; William H. Murray

[57] ABSTRACT

A method for loading and closing containers with flexible open ends employs a chute with an inflatable bladder at the open end, and an elastic closure device. A flexible open end of the container is placed around the end of the chute and the inflatable bladder. The elastic closure device is placed around the open end of the container. The bladder is inflated to secure the container to the chute. Material is delivered into the container through the chute. When a specified quantity of material is loaded into the container, the bladder is deflated causing the container to slide off the chute. When the container slides off the chute, the elastic closure device contracts and closes the flexible open end of container by constricting the size of the flexible open end of the container such that material will not fall out during shipment.

5 Claims, 3 Drawing Sheets

METHOD AND APPARATUS FOR LOADING AND CLOSING A CONTAINER

BACKGROUND OF THE INVENTION

1. Field of the Invention

The present invention relates to methods and apparatuses for loading and closing containers, and, in particular, to loading flexible bags with packages in the field of package shipping.

2. Description of the Related Art

In the field of package shipping, small packages heading to a common destination are often placed in flexible shipping bags for shipment. The process of filling shipping bags with packages manually is extremely labor intensive and, therefore, slow and expensive. Since competitiveness in the package shipping industry depends primarily on efficiency, it is preferable to automate this process. Conventional automatic material bagging systems are too large for use in the package shipping industry which might employ as many as 500 automatic baggers in a single facility. Thus, what is needed are simple, inexpensive, reliable, and compact methods and apparatuses for loading and closing shipping bags.

Accordingly, it is an object of this invention to overcome the disadvantages and drawbacks of the known art and to provide methods and apparatuses for loading and closing shipping bags.

It is a further object of this invention to provide a simple, inexpensive, and reliable apparatus for automating the loading and closing of shipping bags.

Further objects and advantages of this invention will become apparent from a detailed description of a preferred embodiment which follows.

SUMMARY OF THE INVENTION

The present invention is an apparatus for loading and closing a container having a flexible open end. The apparatus comprises a chute having an open end, an inflatable bladder disposed around the open end of the chute, and an elastic closure device placeable around the open end of the container. The elastic closure device closes the open end of the container after the container slides off the open end of the chute after the bladder is deflated.

The present invention is also a method for loading and closing a container having a flexible open end. According to this method, the open end of the container is placed around an inflatable bladder, the bladder being disposed around an open end of a chute. The bladder is then inflated to secure the container to the chute and an elastic closure device is placed around a portion of the open end of the container disposed about the chute. Material is then delivered through the chute into the container. The bladder is then deflated to release the container from the chute, whereby the container slides off the end of the chute and the elastic closure device closes the open end of the container.

DESCRIPTION OF THE PREFERRED EMBODIMENT(S)

Figure 1:
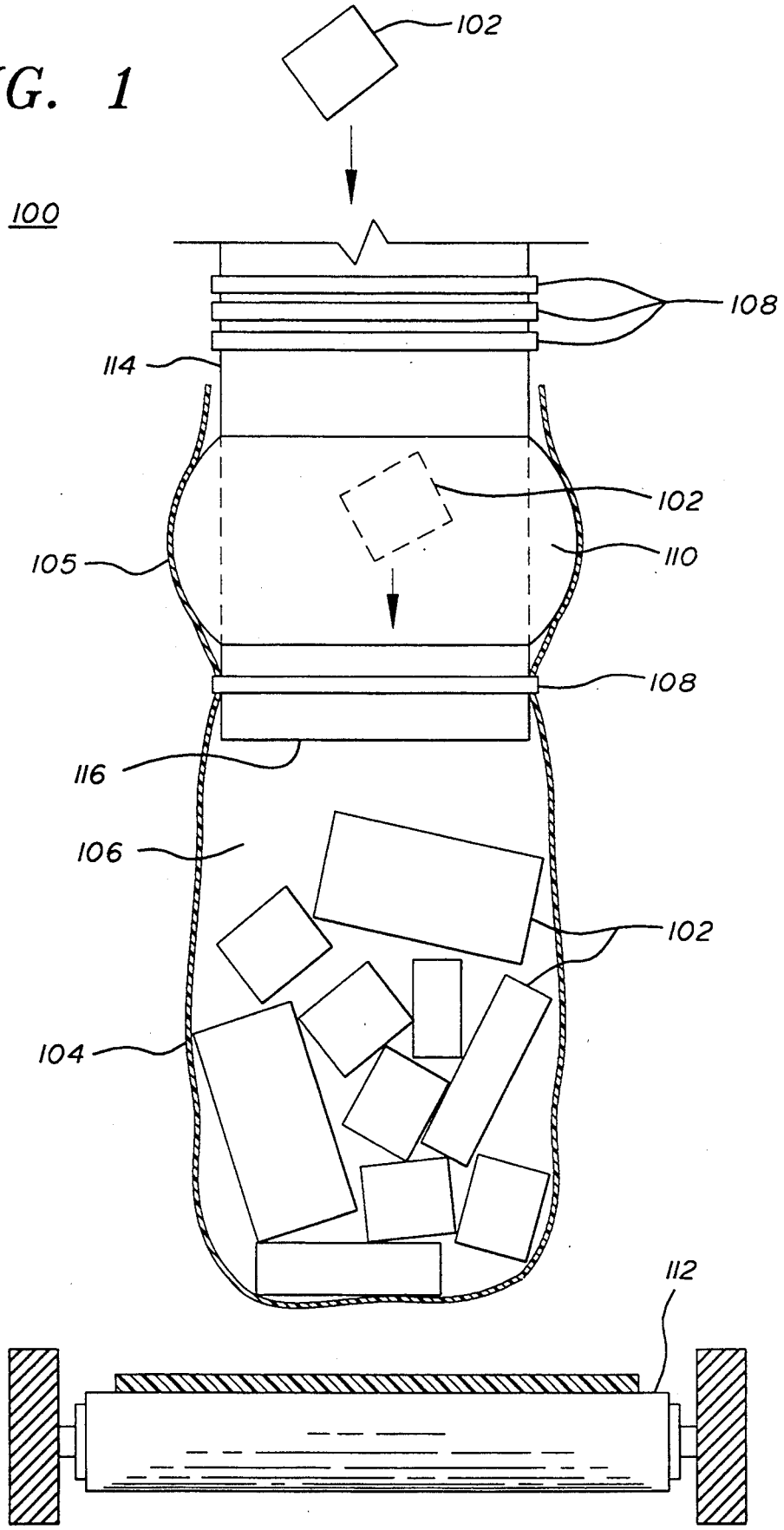
FIG. 1 shows a schematic side view of an apparatus for loading and closing a container with a flexible open end according to a preferred embodiment of the present invention.

Referring now to FIG. 1, there is shown a schematic side view of a loading and closing apparatus 100 for loading and closing a container 104 with a flexible open end 105, according to a preferred embodiment of the present invention. Apparatus 100 comprises a generally cylindrical chute 114 having an open end 116, an inflatable bladder 110, an elastic closure device 108, and a conveyor 112.

Chute 114 is the conduit for material, shown here as packages 102, that may be delivered into container 104. Inflatable bladder 110 is disposed circumferentially around and attached to the exterior surface of chute 114 near open end 116 of chute 114. Bladder 110 is a generally toroidal air-tight sleeve that expands when inflated with air and returns to its original size when deflated. Bladder 110 is made of an air-tight material such as rubber. Bladder 110 is attached to chute 114 by suitable fastening means, such as glue, which does not breach the air-tight seal of the bladder. When bladder 110 is deflated, open end 105 of container 104 can pass freely over chute 114 and bladder 110. When bladder 110 is inflated, it exerts outward pressure on the inner walls of container 104 thereby securing container 104 to chute 114. The diameter of bladder 110 when inflated is selected to be sufficiently great to secure container 104 to chute 114 when container 104 is loaded with packages.

Figure 2:
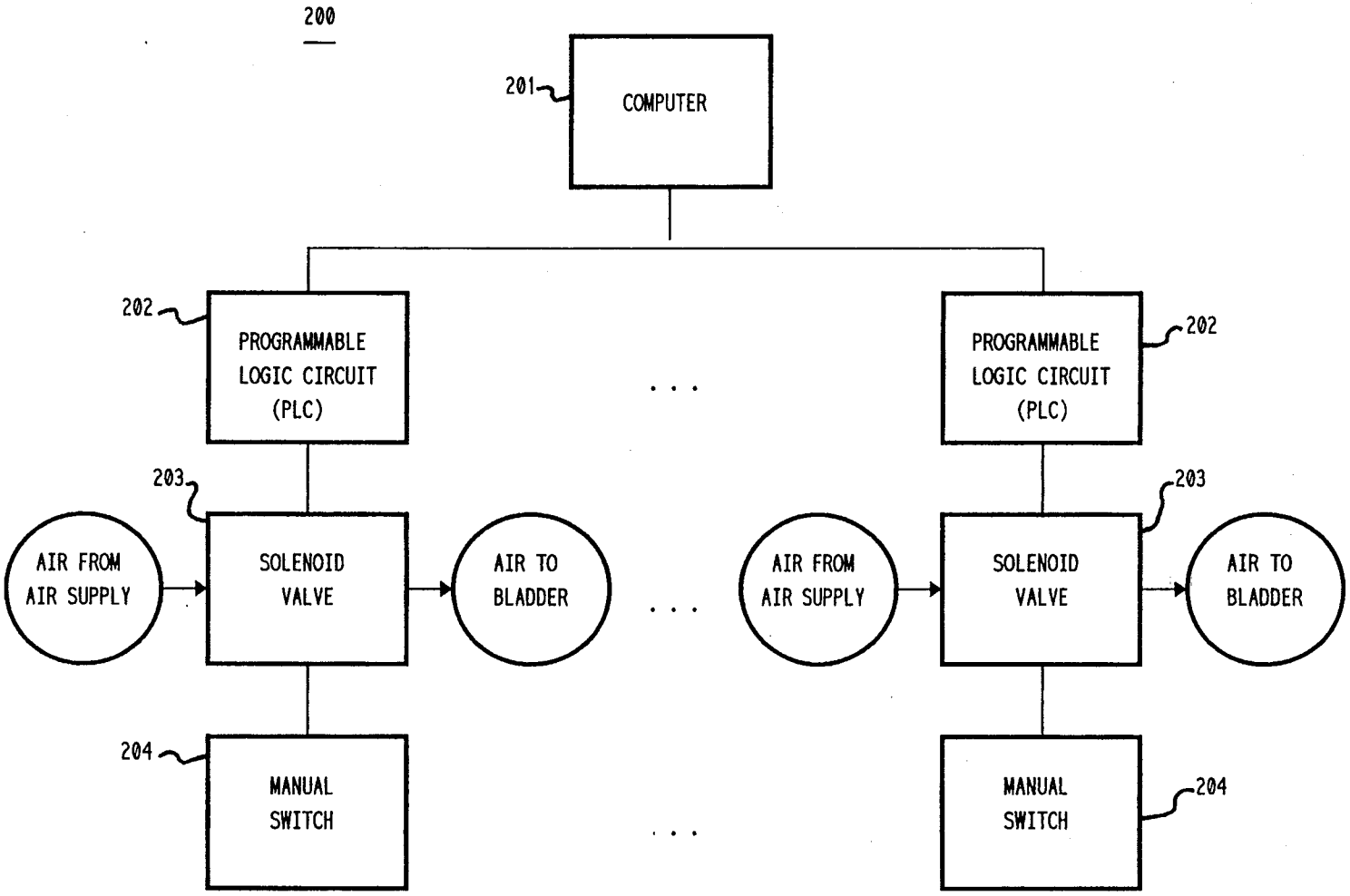
FIG. 2 shows a block diagram of a control system for controlling the apparatus of FIG. 1.

Referring now to FIG. 2, there is shown a block diagram of control system 200 for controlling the operations of a plurality of apparatuses 100 of FIG. 1 in conjunction with a system for sorting packages. Those skilled in the art will understand that the system may be any suitable system for sorting packages, such as an SBIR package sorting system sold by CML Corporation of Italy or a tilt-tray system sold by Logan Corporation. The control system 200 comprises a computer 201 and, for each apparatus 100, a programmable logic circuit (PLC) 202, a two-position solenoid valve 203, and a manual switch 204.

Computer 201 of control system 200 controls the delivery of packages through a plurality of chutes 114 of FIG. 1. In a preferred embodiment, computer 201 is a microprocessor-based personal computer programmed to route packages 102 to the appropriate chutes 114, count the number of packages 102 delivered to each chute 114, stop the routing of packages 102 to a chute 114 when a specified number of packages 102 have been delivered to that chute 114, and deflate bladder 110 of the corresponding chute 114.

For each chute 114 controlled by computer 201, computer 201 is connected to a PLC 202, which is preferably a standard industrial computer manufactured by, for example, Allen Bradley, General Electric, Siemans, or Mitsubishi. PLC 202 is connected to the two-position solenoid valve 203 and signals the solenoid valve 203 to deflate the bladder 110 of apparatus 100 of FIG. 1 when a corresponding signal from the computer 201 is received.

The two-position solenoid valve 203 directly controls the inflation and deflation of bladder 110. The solenoid valve is mechanically connected to a pressurized air supply (not shown) and to the interior of the bladder 110. When the solenoid valve 203 is in the closed position, the interior of the bladder 110 is closed to the environment and open to the pressurized air supply, thereby causing the bladder 110 to inflate. When the solenoid valve 203 is in the open position, the interior of the bladder 110 is open to the environment and closed to the pressurized air supply, thereby causing the bladder 110 to deflate. Those skilled in the art will understand that, if available, the pressurized air supply is preferably part of the package sorting system.

The solenoid valve 203 is electrically connected to the PLC 202 and to the manual switch 204. The PLC 202 causes the solenoid valve 203 to open in response to an appropriate control signal received from the computer 201. The manual switch 204 may be manually triggered to cause the solenoid valve 203 to close. When the manual switch 204 closes the valve 203, a signal is sent to the computer 201 that the bladder 110 has been inflated.

In a preferred embodiment, the valve 203 is a two-position solenoid valve, such as those manufactured by Air Royal. Those skilled in the art will understand that means other than a two-position solenoid valve may be used to inflate and deflate the bladder 110.

Figure 3:
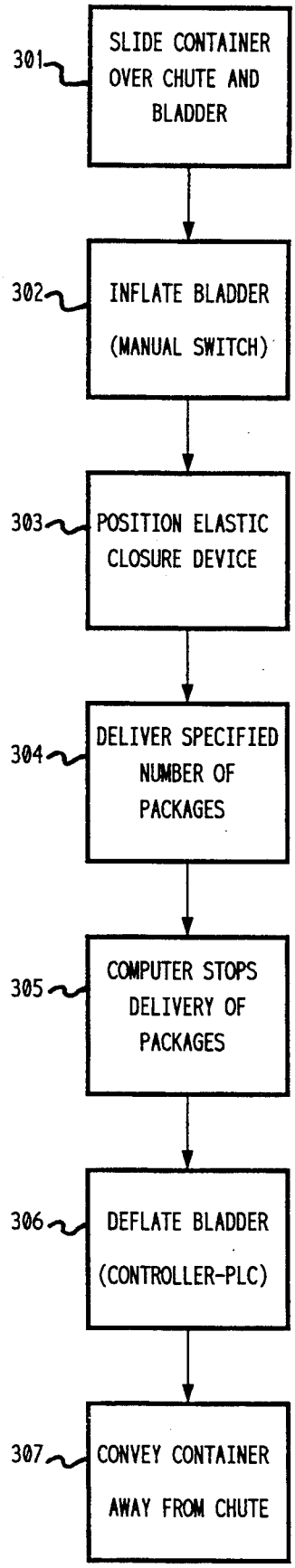
FIG. 3 shows a process flow diagram for the apparatus of FIG. 1.

Referring now to FIG. 3, there is shown a process flow diagram of the operation of apparatus 100 of FIG. 1, according to a preferred embodiment of the present invention. At step 301, an operator slides flexible open end 105 of container 104 over open end 116 of chute 114 and over bladder 110 with bladder 110 in an uninflated state. At step 302, the operator triggers manual switch 204 of FIG. 2 to close solenoid valve 203, thereby causing the bladder 110 to inflate and securing container 104 to chute 114. When the manual switch 204 is used to close the valve 203, a signal is sent to the computer 201 that the bladder 110 has been inflated. At step 303, the operator moves one of elastic closure devices 108 from the storage position above bladder 110 to a position below bladder 110 and around open end 105 of container 104.

At step 304, after the computer 201 receives the signal that the bladder 110 has been inflated, the computer 201 begins delivering packages 102 through chute 114 and into container 104. At step 305, computer 201 recognizes that the specified number of packages 102 have been delivered to chute 114 and stops sending packages 102 to that chute 114. At step 306, computer 201 sends a signal to PLC 202 which in turn signals solenoid valve 203 to open, thereby causing bladder 110 to deflate allowing container 104 to slide off chute 114 onto conveyor 112. When container 104 slides off chute 114, elastic closure device 108 contracts! and closes flexible open end 105 of container 104. At step 307, conveyor 112 conveys closed container 104 away from open end 116 of chute 114.

Closure device 108 is preferably, made of an elastic material in the form of a ring, such as rubber, the elasticity of which is sufficient to close flexible open end 105 of container 104 when container 104 slides off chute 114. Elastic closure device 108 preferably allows container 104 to slide off chute 114 when bladder 110 is deflated. Those skilled in the art will understand that the desired coefficient of expansion of elastic closure device 108 depends on the type of container 104 selected for use in apparatus 100. In a preferred embodiment, in which container 104 is a canvas bag, elastic closure device 108 is made from Kraton ® rubber made by Shell Corporation and has a coefficient of expansion of approximately 1/1750.

In a preferred embodiment of the present invention, elastic closure device 108 is disposed around flexible open end 105 of container 104 below bladder 110 but above the end of chute 114. Additional elastic closure devices 108 may be stored disposed around chute 114 above flexible open end 105 of container 104 for use with subsequent containers. In alternative embodiments, elastic closure device 108 may be built into container 104.

Conveyor 112 is disposed below chute 114. Conveyor 112 is as close as possible to the open end of chute 114 while allowing container 104 to hang from chute 114 without touching conveyor 112. As a result, when container 104 slides off chute 114, the risk of damage to packages 102 is minimized.

The present invention may be embodied in other specific forms without departing from the spirit or essential attributes of the invention. For example, it will be understood by those skilled in the art that the present invention may be used to load material other than packages into flexible containers. For example, apparatus 100 may be used to load loose particulate matter, liquids, and other objects or materials. In addition, apparatus 100 may be used to load containers with flexible open ends other than canvas bags.

It will also be understood by persons skilled in the art that computer 201 may be programmed to deliver a specified volume or weight of material to container 104 rather than a specified number of units. Alternatively, computer 201 may be programmed to deliver material for a specified period of time.

It will be further understood that various other changes in the details, materials, and arrangements of the parts which have been described and illustrated in order to explain the nature of this invention may be made by those skilled in the art without departing from the principle and scope of the invention as expressed in the following claims.

What is claimed is:

1. A method for loading and closing a container having a flexible open end, comprising the steps of:

(a) placing the open end of the container around an inflatable bladder, the bladder being disposed around an open end of a chute;

(b) inflating the bladder to secure the container to the chute;

(c) placing an elastic closure device around a portion of the open end of the container disposed about the chute;

(d) delivering material through the chute into the container; and (e) after step (c), deflating the bladder to release the container from the chute, whereby the container slides off the end of the chute and the elastic closure device automatically closes the open end of the container.

2. The method of claim 1, further comprising the step of:

(f) conveying the container away from the chute after the container slides off the end of the chute.

3. The method of claim 1, wherein said step (b) comprises the step of triggering a manual switch to close a valve to inflate the bladder.

4. The method of claim 1, wherein said steps (d) and (e) are controlled by a computer electrically connected to a programmable logic circuit, the programmable logic circuit being electrically connected to a valve that controls the inflation and deflation of the bladder.

5. The method of claim 1, wherein said step (b) comprises the step of triggering a manual switch to inflate the bladder, said steps (d) and (e) are controlled by a personal computer electrically connected to a programmable logic circuit, the programmable logic circuit being connected to a solenoid valve that controls the inflation and deflation of the bladder, and further comprising the step of:

(f) conveying the container away from the chute after the container slides off the end of the chute.

* * * * *